US006217956B1

(12) United States Patent
Heidkamp

(10) Patent No.: US 6,217,956 B1
(45) Date of Patent: Apr. 17, 2001

(54) TRANSPARENT ORNAMENT WITH TRANSPARENT PICTURE THEREIN AND METHOD OF MANUFACTURE THEREOF

(76) Inventor: Marsha L. Heidkamp, 327 Linnview Ave., Pittsburgh, PA (US) 15210

( * ) Notice: Subject to any disclaimer, the term of this patent is extended or adjusted under 35 U.S.C. 154(b) by 0 days.

(21) Appl. No.: 09/366,856

(22) Filed: Aug. 4, 1999

(51) Int. Cl.[7] ..... A47G 33/04

(52) U.S. Cl. ..... 428/11; 428/13; 428/14; 428/34.1; 428/34.4; 428/42.1; 428/542.2; 428/542.4; 428/913.3; 283/110

(58) Field of Search ..... 428/11, 14, 542.4, 428/542.2, 913.3, 34.1, 13, 34.4, 7, 42.1; 283/107, 110

(56) References Cited

U.S. PATENT DOCUMENTS

| | | | |
|---|---|---|---|
| 2,519,248 | 8/1950 | Hulbert | 46/100 |
| 3,624,939 | 12/1971 | Gossard | 40/10 |
| 3,694,648 | 9/1972 | Yates | 240/10 T |
| 3,802,104 | 4/1974 | Wiley | 40/152 |
| 4,173,667 | 11/1979 | Rusch | 428/11 |
| 4,224,364 | 9/1980 | Hunt | 428/11 |
| 4,968,565 | 11/1990 | Stefano | 428/542.4 |
| 5,160,566 | 11/1992 | Ashby et al. | 156/252 |
| 5,254,026 | 10/1993 | Kaiser | 446/220 |
| 5,273,794 | 12/1993 | Engel | 428/11 |
| 5,649,874 | 7/1997 | Headford et al. | 473/569 |
| 5,806,895 * | 9/1998 | Sharabani | 283/61 |
| 5,834,073 | 11/1998 | Greenblat et al. | 428/13 |

* cited by examiner

*Primary Examiner*—Deborah Jones
*Assistant Examiner*—Abraham Bahta
(74) *Attorney, Agent, or Firm*—Webb Ziesenheim Logsdon Orkin & Hanson, P.C.

(57) ABSTRACT

An ornament is formed from a transparent body, such as a globe, having a transparent film received therein. The transparent film includes a translucent image formed thereon. The transparent film is configured so that one or more points of a periphery of the film contact an inside surface of the body when the film is received therein. When viewed from the external body, the translucent image appears to be floating in the body.

15 Claims, 5 Drawing Sheets

TRANSPARENT ORNAMENT WITH TRANSPARENT PICTURE THEREIN AND METHOD OF MANUFACTURE THEREOF

BACKGROUND OF THE INVENTION

1. Field of the Invention

The present invention relates to ornaments and, more particularly, to transparent ornaments.

2. Description of the Prior Art

Ornaments are used as decorations to create an aesthetically pleasing effect, particularly during a holiday season. Ornaments, such as Christmas tree ornaments, may have many shapes, sizes, and colors. However, the most common ornament is a globe having a decorative finish and a hanger for attachment to a support, such as a tree branch.

A personalized ornament can be created from raw materials, such as papier-mâché, paint, and the like. Moreover, as shown in U.S. Pat. No. 3,694,648 to Yates, a photograph or photographic transparency 12 can be received in a holder 15 disposed in a transparent or translucent housing. A lamp and a lens 31 can be positioned on opposite sides of holder 15 for projecting light through the photograph or photographic transparency and for limiting viewing within the housing to the area of the photograph or photographic transparency. U.S. Pat. No. 4,173,667 to Rusch discloses an ornament formed from a plurality of housing-forming members 6 which can be snapped together to form a hollow sphere. A greeting card blank 10 can be positioned inside the hollow sphere and indicia or photographs can be mounted on the greeting card blank. U.S. Pat. No. 4,224,364 to Hunt discloses an ornament display container formed from a pair of housing sections connected together by a connecting ring. Pictures can be positioned back-to-back on opposite sides of the housing ring for viewing through the housing sections.

A disadvantage of prior art ornaments is the need for mounting hardware to support pictures within the ornaments. This mounting hardware increases the cost and complexity of these prior art ornaments, and, in some instances, may interfere with the aesthetics of the ornament. Another disadvantage is the inability to view an image received in the ornament from both sides thereof.

It is therefore an object of the present invention to overcome the above disadvantages and others by providing an ornament that is easy to assemble and which enables images received on a film substrate positioned in the ornament to be viewed from both sides of the substrate. Still other objects will become apparent to those of ordinary skill in the art upon reading and understanding the following detailed description.

SUMMARY OF THE INVENTION

Accordingly, I have invented an ornament that includes an optically transparent and hollow globe and an optically transparent film formed from a material having a shape-memory which urges the film planar. The film is received in the globe with the shape-memory urging a periphery of the film into contact with an interior surface of the globe. A translucent image received on the film is viewable as a forward image from one side of the film and viewable as a reverse image from the other side of the film.

The film is formed so that the shape-memory causes one or more points of the periphery thereof to contact the interior surface of the globe.

The globe can include an opening for receiving the film into the globe. The globe can also include a hollow neck having a proximal end connected to the globe and a distal end extending away from the globe. The hollow neck can define the opening in the globe. A cap can be received over the distal end of the hollow neck and a fastener can be attached to the cap on a side thereof opposite the opening in the globe.

Preferably, the material forming the substrate is a plastic film and the image is received on the film by photocopying.

Alternatively, the opening can be a slot formed in the body of the globe. The globe can also be formed from a plurality of globe parts configured to be coupled together to form the globe.

I have also invented a method of making an ornament. The method includes providing a hollow and optically transparent globe and providing an optically transparent film having a shape-memory which urges the film planar. A translucent image is formed within a periphery of the film. The translucent image is viewable as a forward image from one side of the film and viewable as a reverse image from the other side of the film. The film is configured to be received in the globe so that the shape-memory urges one or more points of a periphery of the film into contact with an interior surface of the globe. The film with the image received thereon is positioned inside the globe with the shape-memory urging one or more points of the periphery of the film into contact with the interior surface of the globe.

To position the film inside the globe, the film can be rolled into a spiral having an outside diameter less than a diameter of an opening in the globe. The rolled film can be inserted through the opening in the globe. When the rolled film is received in the globe, the shape-memory of the film causes the film to unroll so that one or more points of the periphery of the film contact the interior surface of the globe thereby securing the film inside the globe. Alternatively, the film can be positioned inside the globe by inserting the film into a slot in the globe.

A cap can be secured over the opening in the globe and a hanger can be secured to the cap.

Lastly, I have invented an ornament having a hollow and optically transparent body and an optically transparent film received in the body. The film has a shape-memory which urges the film planar whereby one or more points of a periphery of the film contact the interior surface of the body to secure the position of the film inside the body. A translucent image received on the film is viewable as a forward image from one side of the film and viewable as a reverse image from the other side of the film.

The body can include an opening for receiving the film therethrough between an exterior of the body and an interior of the body. A hollow cylinder can be positioned coaxially with the opening. The hollow cylinder can have a proximal end connected to the body and a distal end extending away from the body. A cap can be secured over the distal end of the hollow cylinder.

DETAILED DESCRIPTION OF THE PREFERRED EMBODIMENTS

Figure 1:
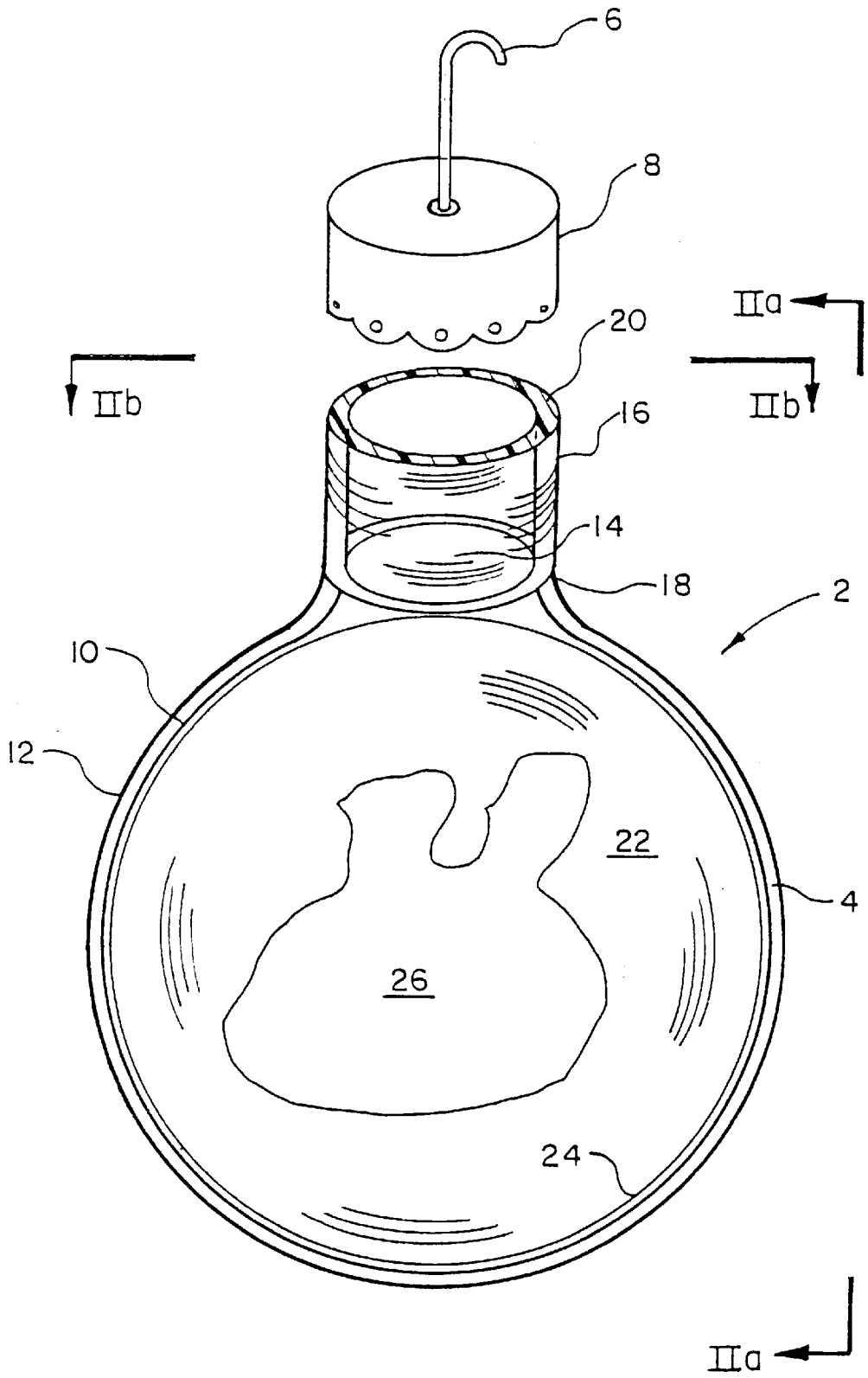
FIG. 1 is a perspective view, partially exploded, of an ornament in accordance with one embodiment of the present invention.

With reference to FIG. 1, an ornament 2 includes a hollow and optically transparent body 4 which can be attached to a support (not shown), such as a tree branch, via a fastener 6 which is connected to the body 4 by a cap 8. Preferably, body 4 has a spherical or globe shape, however, this is not to be construed as limiting the invention.

Body 4 has an interior surface 10 defining the interior of body 4 and an exterior surface 12 defining an exterior of body 4. Body 4 includes an opening 14 therein. Preferably, opening 14 is circular, however, the shape of opening 14 is not to be construed as limiting the invention. Body 4 includes a hollow neck 16 having a proximal end 18 connected to, or formed integral with, body 4 and a distal end 20 extending away from body 4. Preferably, hollow neck 16 is formed integral with body 4 and defines opening 14 which extends between proximal end 18 and distal end 20 of hollow neck 16.

Ornament 2 includes an optically transparent film 22 received in body 4. Film 22 is formed from a material having a shape-memory which urges film 22 planar. Film 22 is formed into a shape having a periphery which substantially conforms to a shape of the interior surface 10 of body 4.

Figure 2A:
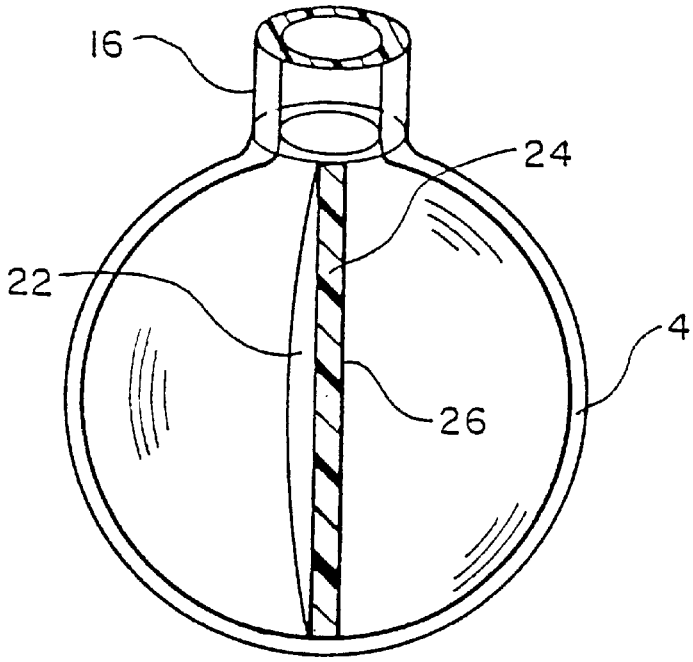
FIG. 2*a* is a side perspective view taken along lines IIa—IIa in FIG. 1.
Figure 2B:
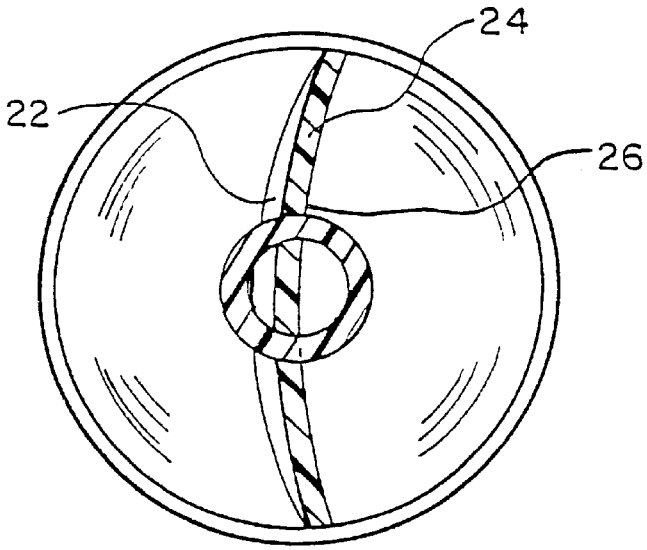
FIG. 2*b* is a top perspective view taken along lines IIb—IIb in FIG. 1.

With reference to FIGS. 2*a*–2*b* and with ongoing reference to FIG. 1, preferably, film 22 is formed so that the shape-memory thereof urges periphery 24 into contact with interior surface 10 of body 4 to secure the position of film 22 inside body 4. Preferably, film 22 is formed and shaped so that periphery 24 contacting interior surface 10 compresses film 22 against the shape-memory urging film 22 planar. This compression causes film 22 to have a slightly convex or concave shape, as shown in FIGS. 2*a*–2*b*.

A translucent image 26 is received on film 22 and is viewable as a forward image from one side of film 22 and viewable as a reverse image from the other side of film 22. Since translucent image 26 is received on transparent film 22, which is received in transparent body 4, image 26 appears to be "floating" inside body 4 regardless of which side of film 22 is viewed.

Figure 3:
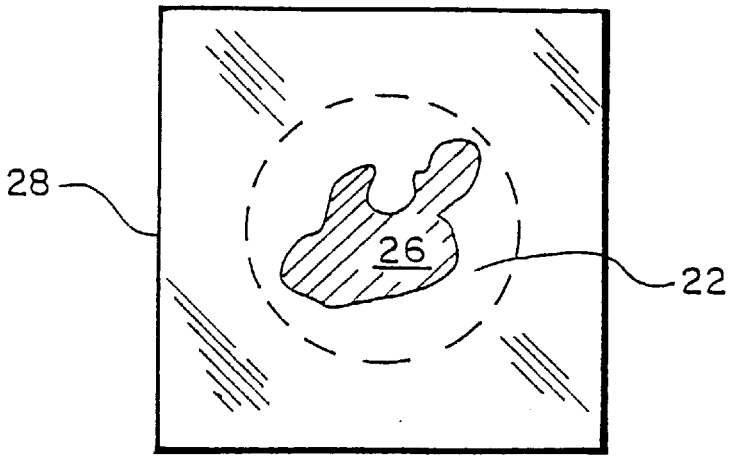
FIG. 3 is a front view of a transparent sheet having a translucent image received on a portion thereof.

With reference to FIG. 3, and with ongoing reference to all previous figures, film 22 is preferably formed from a sheet 28 of plastic film having translucent image 26 formed thereon. Preferably, translucent image 26 is formed on sheet 28 by photocopying an original image (not shown) onto sheet 28. Thereafter, a portion of sheet 28 including image 26 is excised from film 28 to form film 22 having a shape that conforms substantially to the shape of interior surface 10 of body 4.

Figure 4:
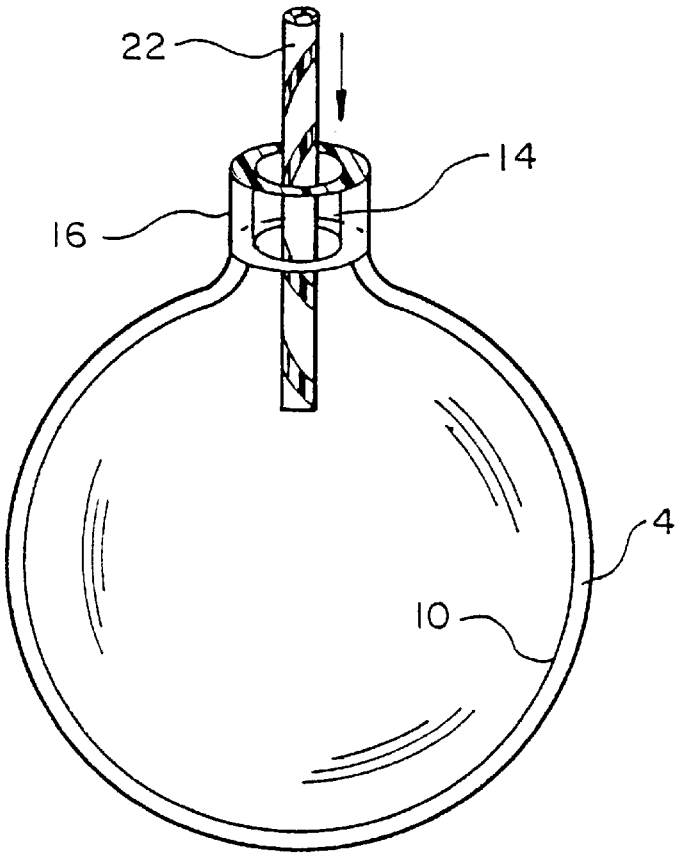
FIG. 4 is a perspective view of the portion of the sheet in FIG. 3 rolled into an elongated tube and being received through an opening in a transparent globe.

With reference to FIG. 4, and with ongoing reference to all previous figures, the film 22 is rolled into a tube having an outside diameter smaller than an inside diameter of opening 14. Film 22, thus formed into a tube shape, is inserted through opening 14 into body 4. Once received in body 4, the shape-memory causes film 22 to unroll from its tube shape and urge film 22 planar with one or more points of periphery 24 contacting interior wall 10 of body 4. Contact between one or more points of periphery 24 and interior surface 10 secures film 22 in position inside body 4.

When film 22 is received in body 4, cap 8 with fastener 6 connected thereto can be connected to distal end 20 of hollow neck 16. When cap 8 and fastener 6 are secured to neck 16, ornament 2 can be suspended from a support, such as a branch of a tree, a protrusion, and the like, in a manner known in the art.

Figure 5A:
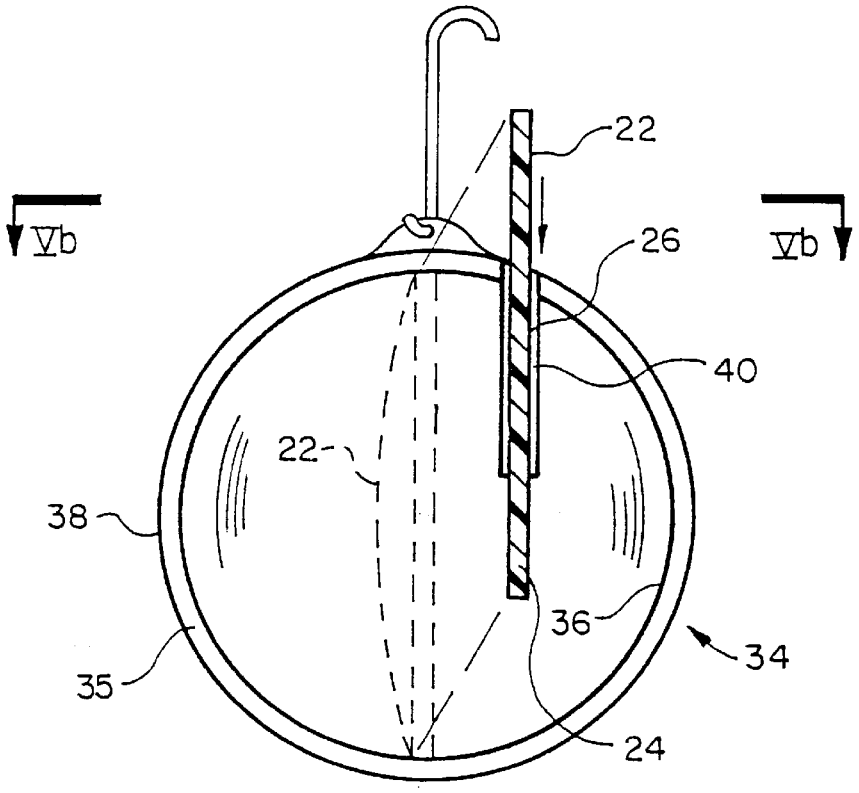
FIG. 5*a* is a perspective view of an ornament in accordance with another embodiment of the present invention including a slot configured to receive the portion of the sheet shown in FIG. 3.
Figure 5B:
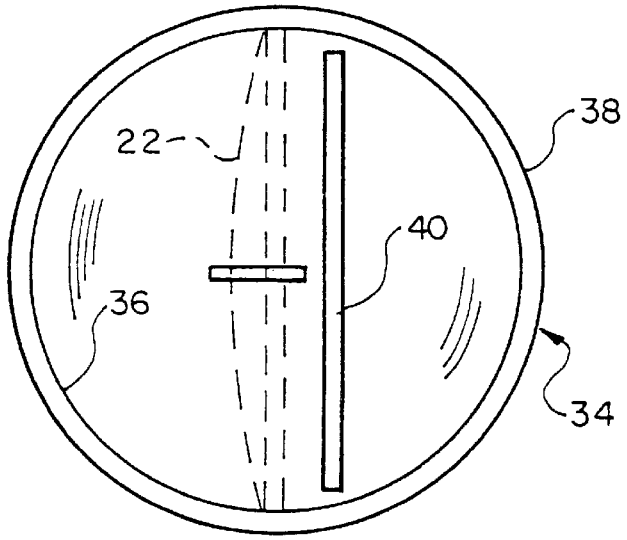
FIG. 5*b* is a perspective view taken along lines Vb—Vb in FIG. 5*a*.

With reference to FIGS. 5*a* and 5*b*, in another embodiment, an ornament 34 includes a body 35 having an interior surface 36, an exterior surface 38, and a slot 40 formed therein. Preferably, slot 40 is configured to receive therethrough film 22 having image 26 formed thereon. As described above in connection with FIGS. 1–4, film 22 is configured so that one or more points of periphery 24 contact interior surface 36 of ornament 34 thereby securing film 22 in position inside body 35. This contact between one or more points of periphery 24 and interior surface 36 of ornament 34 causes film 22 to have a slightly convex or concave shape, as shown in phantom in FIGS. 5*a* and 5*b*.

Figure 6:
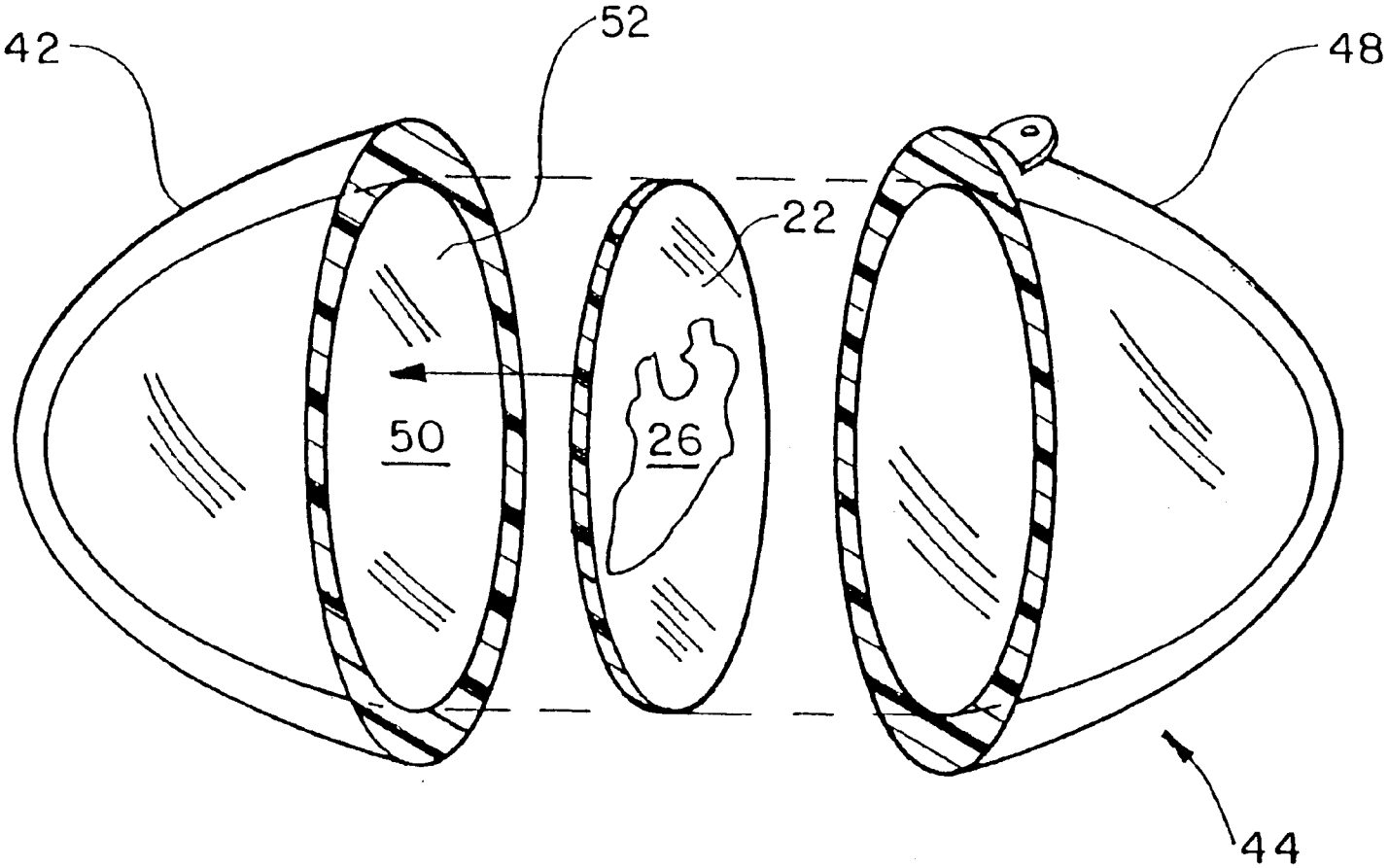
FIG. 6 is an exploded perspective view of an ornament in accordance with another embodiment of the present invention including mating globe portions positioned on opposite sides of the portion of the sheet shown in FIG. 3.

Lastly, with reference to FIG. 6, in another embodiment, an ornament 44 is formed from a plurality of transparent body parts 48 configured to be mated to form ornament 44 having hollow interior 50 defined by an interior surface 52 of each transparent body part 48. To receive film 22 with image 26 formed thereon inside ornament 44, film 22 is inserted into one of the transparent body parts 48 with one or more points of periphery 24 contacting interior surface 52 thereof. Thereafter, the plurality of transparent body parts 48 are mated together to form ornament 44. Alternatively, transparent body parts 48 can be assembled around film 22 so that one or more points of periphery 24 contact interior surface 52 of more than one transparent body part 48.

As can be seen, the present invention is an ornament formed from a transparent body, such as a globe or sphere, having a translucent image formed on a transparent substrate received in the body. Since the body and the film are transparent, the translucent image appears to be "floating" in the body when viewed from either side of the film. Moreover, as can be seen, the present invention is a method for forming the ornament of the present invention.

The present invention has been described with reference to the preferred embodiments. Obvious modifications and alterations will occur to those of ordinary skill in the art upon reading and understanding the proceeding detailed description. It is intended that the invention be construed as including all such modifications and alterations insofar as they come within the scope of the appended claims or the equivalents thereof.

I claim:

1. An ornament comprising:

an optically transparent and hollow globe;

an optically transparent film formed from a material having a shape-memory which urges the film planar; and a translucent image received on the film and viewable as a forward image from one side of the film and viewable as a reverse image from the other side of the film, wherein:

the film is configured to be positioned in the globe with the shape-memory urging a periphery of the film into contact with an interior surface of the globe; and the forward image and the reverse image are spaced from the interior of the globe when the film is positioned in the globe.

2. The ornament as set forth in claim 1, wherein the film is formed so that the shape-memory causes one or more points of the periphery thereof to contact the interior surface of the globe.

3. The ornament as set forth in claim 1, further including an opening formed in the globe for receiving the film into the globe.

4. The ornament as set forth in claim 3, wherein:

the globe further includes a hollow neck having a proximal end connected to the globe and a distal end extending away from the globe; and the hollow neck defines the opening in the globe.

5. The ornament as set forth in claim 5, further including a cap received over the distal end of the hollow neck.

6. The ornament as set forth in claim 4, further including a fastener attached to the cap on a side thereof opposite the opening in the globe.

7. The ornament as set forth in claim 1, wherein the optically transparent is a plastic film.

8. The ornament as set forth in claim 7, wherein the image is received on the film by photocopying.

9. The ornament as set forth in claim 2, wherein the opening is a slot formed in a body of the globe.

10. The ornament as set forth in claim , wherein the globe is formed from a plurality of globe parts configured to be coupled together to form the globe.

11. An ornament comprising:

a hollow and optically transparent body;

an optically transparent film having a shape-memory which urges the film planar, the film being configured to be positioned in the body so that the shape-memory urges one or more points of a periphery of the film into contact with an interior surface of the body to secure the position of the film inside the body; and a translucent image received on the film and viewable as a forward image from one side of the film and viewable as a reverse image from the other side of the film, wherein the forward image and the reverse image are spaced from the interior surface of the body when the film is positioned in the body.

12. The ornament as set forth in claim 11, wherein the body includes an opening for receiving the film therethrough between an outside of the body and an inside of the body.

13. The ornament as set forth in claim 12, further including a hollow cylinder positioned coaxially with the opening, the hollow cylinder having a proximal end connected to the body and a distal end extending away from the body.

14. The ornament as set forth in claim 12, further including a cap secured over the distal end of the hollow cylinder.

15. The ornament as set forth in claim 11, wherein:

the film is a plastic film; and the image is received on the film by photocopying.

* * * * *